United States Patent [19]

Canterbury

[11] 4,063,594

[45] * Dec. 20, 1977

[54] PRESSURE-BALANCED WELL SERVICE VALVE

[75] Inventor: Robert Houston Canterbury, Hobbs, N. Mex.

[73] Assignee: Dresser Industries, Inc., Dallas, Tex.

[ * ] Notice: The portion of the term of this patent subsequent to Oct. 26, 1996, has been disclaimed.

[21] Appl. No.: 695,278

[22] Filed: June 11, 1976

Related U.S. Application Data

[63] Continuation of Ser. No. 555,778, March 6, 1975.

[51] Int. Cl.[2] ..... E21B 43/00

[52] U.S. Cl. ..... 166/325; 137/529

[58] Field of Search ..... 166/224 A, 224 R, 225, 166/305 R, 134, 150–152; 137/529, 505.16, 505.18, 513.7

[56] References Cited

U.S. PATENT DOCUMENTS

| | | | |
|---|---|---|---|
| 2,033,563 | 3/1936 | Wells | 166/320 |
| 2,268,010 | 12/1941 | Baum | 166/334 |
| 2,757,741 | 8/1956 | O'Reilly | 166/325 |
| 3,032,111 | 5/1962 | Corley, Jr. et al. | 166/332 |
| 3,319,717 | 5/1967 | Chenoweth | 166/320 |
| 3,796,261 | 3/1974 | Nutter | 166/152 |

*Primary Examiner*—James A. Leppink
*Attorney, Agent, or Firm*—Michael J. Caddell

[57] ABSTRACT

A well service valve used primarily for the injection of closely controlled batches of well treating fluids into low pressure formations utilizes a biased one-way flow valve in a tubing string to hold the treating fluid in the column until the tubing is pressurized to open the valve and expose flow ports in the wall of the tubing to the formation. A partial pressure-balancing of the flow valve allows the use of a lower biasing force in the flow valve, thereby greatly increasing the reliability and useful life of the valve.

3 Claims, 2 Drawing Figures

PRESSURE-BALANCED WELL SERVICE VALVE

CROSS-REFERENCE TO RELATED APPLICATIONS

This application is a continuation of an original copending application, Ser. No. 555,778, filed Mar. 6, 1975, by Robert H. Canterbury and entitled "PRESSURE-BALANCED WELL SERVICE VALVE".

BACKGROUND OF THE INVENTION

This invention involves an improvement in well service valves for injection of treating fluid into low pressure formations. More specifically, this invention provides an improved well treating valve having a partial pressure-balancing system. There are several known treating valves utilizing the spring loaded checkvalve principle to inject fluids in precontrolled amounts into low pressure formations. Examples of one type of such valve are disclosed in the Burt reissue U.S. Pat. No. RE 22483, the Watson U.S. Pat. No. 3,802,507, and in the 1964–65 World Oil Composite Catalog, pages 3680 and 3681. All of the above mentioned devices utilize a coil spring biasing means on a checkvalve member to provide well injection valve systems. The basic disadvantage with these devices is that the biasing means utilized must be of sufficient strength to provide a biasing force exceeding the hydrostatic pressure in the tubing due to the column of fluid above the valve.

In some of the deeper wells, this results in utilizing a very stiff biasing spring to obtain proper operation of the injection valve. Because of this requirement, the valve usually operates only a few times successfully because of weakening or breaking of the stiff valve spring. The present invention overcomes these disadvantages by providing an injection valve having a partial pressure-balancing feature which eliminates the need for a heavy biasing spring since the high hydrostatic pressure head above the valve in the tubing is substantially offset by the partial pressure-balancing feature. The present invention allows the use of a weaker, more resilient biasing means such as a coil spring.

DESCRIPTION OF THE PREFERRED EMBODIMENTS

Figure 1:
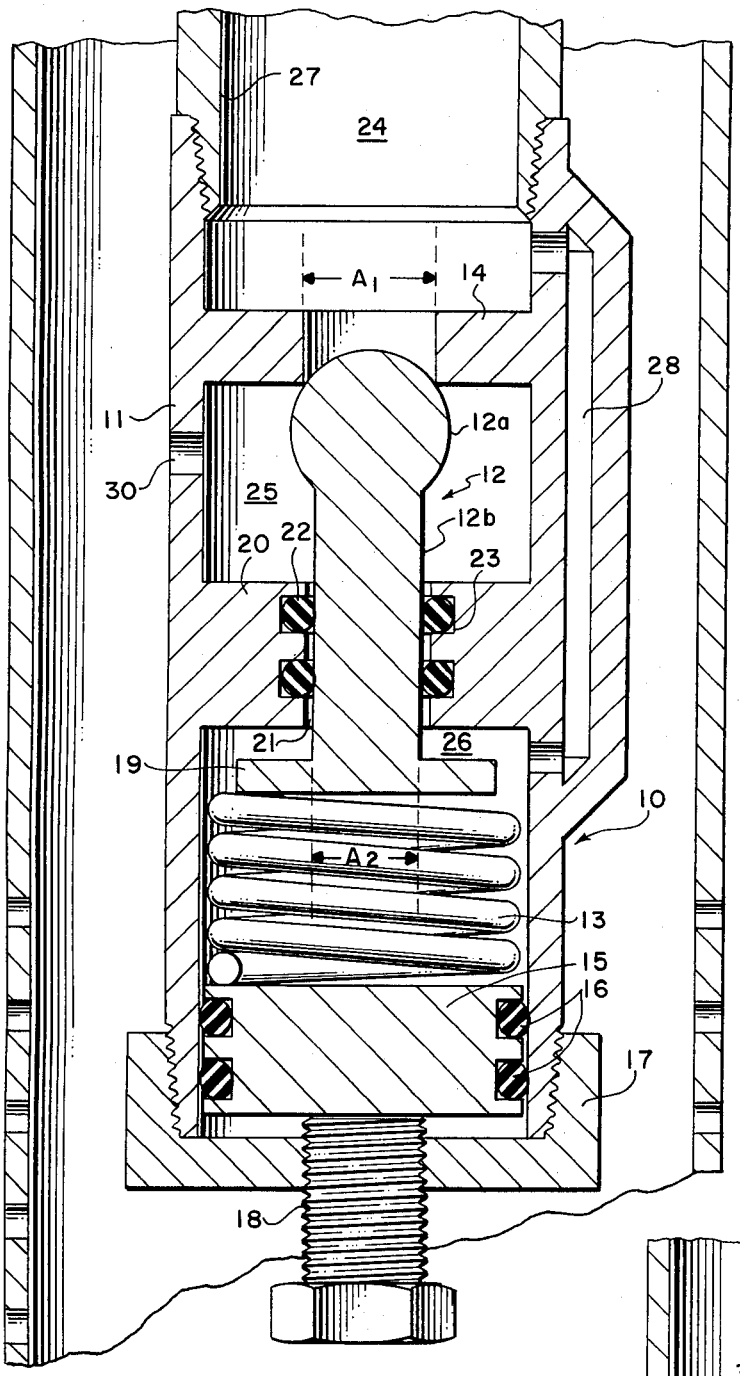
FIG. 1 is a schematic cross-sectional view of the injection valve of this invention.

Referring now to FIG. 1, the pressure-balanced service valve 10 is shown in cross-section having a generally tubular elongated body 11 in which is slidably located a valve member 12. A compression coil spring 13 abuts valve member 12 and urges valve member 12 into sealing engagement with valve seat 14 secured to the inner wall of housing 11. A slidable abutment base 15 is located in the bottom of housing 11 and is sealingly engaged therein by means of circular seals 16. Abutment base 15 provides a slidable base for the abutment of spring 13. A housing cap 17 is secured at the lower end of housing 11 and closes off the bore passage therethrough. A threaded adjustment member 18 is threadedly engaged in cap 17 extending upward into housing 11 for abutment with base 15 to provide compression adjustments for spring 13.

Likewise, valve member 12 has a widened base 19 to provide an abutment surface for the upward end of the coil spring 13. Valve member 12 comprises upper generally spherical seating end **12*a*, an elongated generally cylindrical valve body 12*b*, and the aforementioned spring abutment face 19 at the lower end thereof. Housing 11 has an inwardly projecting shoulder 20 forming an annular partition in housing 11 through which member 12 passes, with section 12*b* being in close proximity to the inner bore 21 in partition 20. One or more circular seals 22 are provided in grooves 23 in inner bore 21 which circular seals sealingly contact elongated valve body 12*b***.

The inner bore passage 24 of the tubing string is divided by the annular sealing shoulder 14 and sealing partition 20 into a valve flow chamber 25 and a pressure-balance chamber 26. Flow of fluids down the tubing string 27 may progress through bore 24 and chamber 25 into the formation and flow by means of a bypass channel 28 into chamber 26. Fluids in chamber 26 are restricted therein by the various seal members 16 and 22 so that no fluid may escape therefrom.

Likewise, fiuid flow between chambers 25 and 26 is also prohibited. The flow of fluids through bypass channel 28 from bore passage 24 to pressure chamber 26 results in a pressure force upward on member 12 which is directly proportional to the area swept by circular seals 22, said area being designated in FIG. 1 by the dimension $A_2$ and being circular in shape or corresponding in shape to the cross-sectional configuration of section **12*b* of valve member 12**.

Likewise, a downward pressure occurs across the area atop valve member **12*a*, which pressure is equivalent to the area of the opening in valve seating shoulder 14, said area being designated at $A_1$. The total resultant pressure acting on valve member 12** is thus related to the difference in areas $A_1$ and $A_2$. This is represented by the relation $F = P(A_1 - A_2)$.

Thus, it can be seen that by varying the areas $A_1$ and $A_2$ the resultant differential pressure on valve member 12 may be made as large or as small a proportion of the downward pressure in the tubing as required or desirable. In a deep well requiring a high hydrostatic pressure in the tubing because of the height of the fluid column therein, the difference $A_1 - A_2$ would advantageously be made small because of the high pressure involved. In a shallower well, the difference $A_1 - A_2$ would preferably be made larger. Thus, the biasing force upward provided by spring 13 to maintain member 12 seated in valve seat 14 prior to the injection operation need only be an amount greater than the resultant differential pressure acting downward on valve member 12. As an alternative to altering the pressure differential area $A_1 - A_2$ for different depths of use, it is clear that a single value of $A_1 - A_2$ for generally mid-range depths may be selected and a fine tuning of the valve for each individual well depth may be obtained by the adjustment of threaded abutment screw 18 upward or downward as the case may be.

For the deeper wells, screw 18 is threaded upward to further compress biasing spring 13 and provide a greater biasing force against the greater hydrostatic head of the fluid column in the tubing. In the shallower wells, screw 18 should be threaded downward to relieve a portion of the biasing force of spring 13 upward against valve member 12 due to the lesser hydrostatic head of the shorter column of fluid in the tubing.

In typical operation, when it is desirable to place a treating fluid on the face of a formation with this invention, the characteristics of the formation including the formation pressure and formation depth are utilized to calculate the hydrostatic head of the fluid that will exist with a full column of fluid in the tubing. From these calculations, the downward resulting differential pressure on valve member 12 is calculated using the formula $P \times (A_1 - A_2)$ and the amount of spring biasing force required to overcome this is introduced by the adjustment of spring 18 against spring base 15 thereby compressing spring 13 to the calculated extent. This establishes a biasing force against valve member 12 calculated to be greater than the resulting downward pressure on member 12 when the valve is in place opposite the formation with a column of fluid thereabove.

The valve is then placed at the lower end of the tubing string below a standard packer such as that disclosed in U.S. Pat. No. 3,548,936 to Kilgore et al, dated Dec. 22, 1970 and U.S. Pat. No. 3,701,382 to Williams, dated Oct. 31, 1972. A bypass valve in the packer is opened and the string is run in the hole with the well fluid being allowed to flow through the bypass valve in the packer and into the tubing string to offset buoyancy of the string. After the string is located properly, with the injection valve 10 in close proximity to the formation face, the packer is set by means such as wireline set, mechanical manipulation of the tubing, or hydraulic set, and the annulus below the packer near the formation is isolated from the rest of the annulus above the formation.

It may then be desirable to circulate out the well fluid existing in the isolated area of the annulus to prevent contamination of the formation by this fluid. This may be accomplished by opening a bypass valve in the packer and pumping the treating fluid into the tubing thereby displacing the well fluid up through the bypass valve into the annulus above the packer. The pumping of fluid through valve 10 during this displacement is accomplished by pressuring the tubing a sufficient amount to overcome the resultant biasing force upward of spring 13 on member 12, thereby forcing member 12 downward through partition 20, opening the bore through seat 14 and communicating ports 30 in the wall of housing 11 with flow area $A_1$.

After displacement of the well fluid has occurred and it is calculated the treating fluid has reached valve 10 and into the isolated area of the annulus, the bypass valve in the packer is closed by manipulation of the string or by other known means and injection of the treating fluid into the formation is accomplished by either continuing the fluid pressure on the tubing or else by increasing the pressure on the tubing to provide a faster injection rate. After the calculated desirable amount of treating fluid has been injected into the formation, it is usually desirable to allow the fluid to set in the formation an extended period of time to maximize the desirable effect gained from the treating fluid. This may be done by releasing pressure on the tubing which thus removes a major portion of the resulting downward differential pressure on valve member 12. The remaining differential pressure on 12 is insufficient to maintain spring 13 compressed and thereby spring 12 moves back upward to set in seat 14 closing off flow from the formation back through the tubing string.

After the treating fluid has been held in the formation the desired period of time, the fluid may be removed from the formation either by means of a shear sleeve or other type of circulating valve between the packer and the injection valve 10 or else the bypass valve through the packer may be opened to allow the fluid to move back up the annulus. After the fluid has been removed from the formation, the string may be pulled from the casing and the treating valve removed from the tubing string to be reused in other wells an indefinite number of times. Thus, it can be seen that by using a pressure relief bypass channel 28, the hydrostatic pressure in the tubing string may be communicated with the lower side of the valve member as well as the upper side and, by proper selection of the pressure areas on valve member, a desirable differential area $A_1 - A_2$ may be established requiring only a relatively resilient low force biasing spring 13 to overcome the downward pressure on member 25 arising from the hydrostatic head. By utilizing a hydrostatic balancing chamber 26 isolated from the flow chamber 25 yet in communication with member 12, a partial pressure-balancing of member 12 may be achieved in order to offset a large portion of the downward hydrostatic pressure existing under the column of fluid in the tubing without allowing any of the fluid to leak out of the pressure-balancing area and into the flow area.

Figure 2:
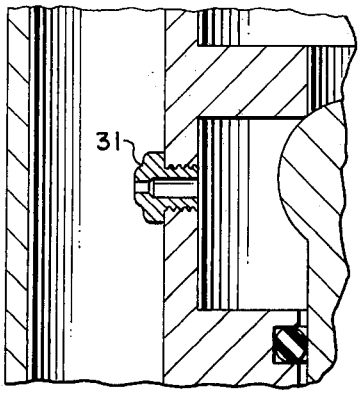
FIG. 2 is a partial schematic cross-sectional illustration of a second embodiment of this valve.

Referring now to FIG. 2, a partial cross-sectional area of flow member 10 is shown wherein a modification of flow ports 30 is disclosed. In the embodiment of FIG. 1, a number of ports 30 through the wall of housing 11 may be varied from one to as many as will fit the periphery of the housing around chamber 25. Preferably, the flow areas through ports 30 are made as large as structurely feasible to provide as low resistance flow as possible.

In the second embodiment in FIG. 2, a modification of the flow ports 30 is provided to obtain additional action from the treating fluid in the formation area. In this embodiment, the number and location of flow port means through the wall of housing 30 are more critical than the location and configuration of ports in FIG. 1. In this embodiment, a number of spraying nozzels 31 are secured in the port openings 30 by means such as welding or threading. The spray nozzels are directed at the formation face and into the annular area around valve 10 so that during the injection of the treating fluid, the fluid is sprayed into the formation face and around the tool to provide a washing jet action to further increase the desirable effects of the treating fluid on the formation. For instance, in some of the wells to be treated, one of the problems attempted to be overcome involves the build-up of paraffin in the formation flow area and in the perforations in the casing. The build-up of paraffin can greatly reduce and even stop the flow of hydrocarbons from the formation into the borehole. Some paraffin build-ups are extremely hard to dissolve and the treating fluids must be strong and must be left in place a great period of time to be effective against such build-ups.

In these circumstances, use of the embodiment in FIG. 2 is particularly advantageous in that the agitation of the treating fluid against the formation face serves to increase many-fold the action of the fluid on the paraffin deposits. Operation of the tool of FIG. 2 is substantially identical to that of the embodiment of FIG. 1.

The jetting system of FIG. 2 is also useful for allowing a washing action on the formation after the injection treatment has been accomplished. A washing fluid may be injected behind the treating fluid and sprayed through jets 31 against the formation to remove sediment, deposits, and residue from the injection treatment. Although certain preferred embodiments of the present invention have been herein described in order to provide an understanding of the general principles of the invention, it will be appreciated that various changes and innovations can be affected in the described valve structure without departure from these principles. For example, whereas a vertically upward acting valve member is disclosed, it is clear that the structure could be inverted by a slight modification of the tool so that the valve member is acting downward with a biasing means pushing the member downward and with the resulting differential pressure on the valve member resulting in an upward force from the hydrostatic fluid pressure. Thus, all modifications and changes of this type are deemed to be embraced by the spirit and scope of the invention except as the same may be necessarily limited by the appended claims or reasonable equivalence thereof.

The embodiments of the invention in which an exclusive property or privilege is claimed are defined as follows:

1. An underground wellbore treating valve assembly for the injection of predetermined quantities of fluids into low pressure downhole formations, said valve assembly comprising:

an elongated tubular housing having a central bore passage therethrough and adapted for sealing engagement in a conduit string;

an annular valve seat formed in the wall of said housing in said bore passage;

an inner annular shoulder formed in said housing below said valve seat;

seal means in said annular shoulder;

a sliding valve member closely fitting in said annular shoulder and having a valve-seat-closing upper portion arranged for sealing engagement with said valve seat;

upward biasing means located below said valve member and in abutment therewith;

bottom abutment means below said biasing means, in abutment therewith, and arranged to retain said biasing means in said housing;

a first pressure response area on top of said valve member and exposed to said valve seat;

a second pressure response area on said valve member below said annular shoulder and of less cross-sectional area than said first pressure response area;

port means through the wall of said housing between said valve seat and said annular shoulder; and, a pressure bypass passage communicating from above said valve seat to below said annular shoulder.

2. The valve assembly of claim 1 wherein said bypass passage is located outside of said housing bore passage.

3. The valve assembly of claim 2 further comprising means for adjusting the biasing force of said biasing means.

* * * * *